US006270519B1

(12) United States Patent
Botts

(10) Patent No.: US 6,270,519 B1
(45) Date of Patent: Aug. 7, 2001

(54) NIPPLE FOR USE WITH LIQUID AND MEDICINE DISPENSING BOTTLE

(75) Inventor: Lynne Marie Botts, Loveland, OH (US)

(73) Assignee: Pedia Med Pharmaceuticals, Inc., Exton, PA (US)

( * ) Notice: Subject to any disclaimer, the term of this patent is extended or adjusted under 35 U.S.C. 154(b) by 0 days.

(21) Appl. No.: 09/629,519

(22) Filed: Aug. 1, 2000

Related U.S. Application Data

(62) Division of application No. 09/290,469, filed on Apr. 12, 1999, now Pat. No. 6,126,679.

(51) Int. Cl.[7] ..... A61J 17/00
(52) U.S. Cl. ..... 606/236; 215/11.1
(58) Field of Search ..... 606/236, 235, 606/234; 215/11.1, 11.2, 11.4; 222/133, 192

(56) References Cited

U.S. PATENT DOCUMENTS

| | | |
|---|---|---|
| D. 377,830 | 2/1997 | Lai . |
| D. 397,216 | 8/1998 | Armand . |
| 3,718,140 | 2/1973 | Yamauchi . |
| 5,101,991 | 4/1992 | Morifuji et al. . |
| 5,244,122 | 9/1993 | Botts . |
| 5,353,964 | 10/1994 | Liu et al. . |
| 5,383,906 | 1/1995 | Burchett et al. . |
| 5,433,343 | 7/1995 | Meshberg . |
| 5,437,381 | 8/1995 | Herrmann . |
| 5,462,203 | 10/1995 | Stern . |
| 5,467,877 | 11/1995 | Smith . |
| 5,487,750 | 1/1996 | Burchett et al. . |
| 5,611,776 | 3/1997 | Simmons et al. . |
| 5,617,966 | 4/1997 | Bral . |
| 5,620,462 | 4/1997 | Valenti . |
| 5,662,684 | 9/1997 | Caso . |
| 5,678,710 | 10/1997 | Sheu . |
| 5,782,561 | 7/1998 | Pai . |
| 5,824,012 | 10/1998 | Burchett et al. . |
| 5,843,030 | 12/1998 | Van Der Merwe . |
| 5,891,165 | 4/1999 | Buckner . |
| 5,897,007 | 4/1999 | Schein et al. . |
| 5,960,971 | 10/1999 | Bral . |

*Primary Examiner*—David O Ref
*Assistant Examiner*—Kevin Truong
(74) *Attorney, Agent, or Firm*—Killworth, Gottman, Hagan & Schaeff, L.L.P

(57) ABSTRACT

A nipple is provided for use with an apparatus for dispensing medicine and liquid to infants. The nipple includes a medicine tube disposed therein which is in communication with one of the discharge openings in the nipple and which allows medicine and other liquids such as formula, juice, etc. to be dispensed separately or simultaneously to an infant. The nipple is preferably comprised of silicone and is formed integrally with the medicine tube. The nipple further includes a webbed membrane which connects the medicine tube to the body portion of the nipple.

2 Claims, 5 Drawing Sheets

NIPPLE FOR USE WITH LIQUID AND MEDICINE DISPENSING BOTTLE

CROSS REFERENCE TO RELATED APPLICATIONS

This application is a division of U.S. patent application Ser. No. 09/290,469, filed Apr. 12, 1999 now U.S. Pat. No. 6,126,679.

BACKGROUND OF THE INVENTION

The present invention relates to a nipple for use with a medicine dispensing bottle, and more particularly, to a nipple including a medicine tube disposed therein which permits medicine, vitamins, or other fluids to be dispensed into an infant's mouth separately or simultaneously with other liquid contained in the bottle.

It is well known in the art that many pharmaceuticals and drugs are provided in liquid form for ease of oral administration to patients such as infants. However, such oral medications generally have an unpleasant or bitter taste which is objectionable to infants. Consequently, many infants will spit the medication out, making it difficult to determine whether the correct dosage has been administered.

Various modified oral compositions as well as devices have been proposed in the prior art to overcome the taste problems associated with conventional dosage forms. For example, Burchett et al, U.S. Pat. Nos. 5,383,906 and 5,487,750, and 5,824,012 teach a nursing bottle in which a syringe is mounted within the bottle for dispensing medication. However, there is open communication through the annular space between the nipple and the interior of the bottle. This could allow the medication to become mixed with the liquid in the bottle, leading to unwanted dilution of the medication in the bottle and inaccurate dosing.

Liu et al., U.S. Pat. No. 5,353,964 teaches a nursing bottle which includes an outer bottle with a detachable nipple and an inner bottle disposed inside the outer bottle. The bottle includes a switch which allows fluid in either bottle to flow into the nipple or to let fluids from both bottles flow into the nipple simultaneously. However, the nipple does not provide an isolated pathway for the medication and there is no control over the rate of drug delivery. Further, the switch is comprised of three separate parts which may become lost or broken during use.

A more effective system is found in my U.S. Pat. No. 5,244,122, which discloses a medicine dispensing bottle which comprises a traditional nursing bottle having an internal receptacle which accommodates a syringe for dispensing medicine. The bottle allows regulated dispensing of medicine along with other liquids commonly ingested by an infant, such as milk or juice, through separate holes in the nipple attached to the bottle. The medicine and liquid can enter the infant's mouth simultaneously, thereby effectively masking the taste of the medicine while obtaining accurate dosing of the medicine. However, the nipple disclosed in my earlier patent is especially designed for use in that system, is not readily interchangeable with other dispensing devices such as those of Burchett et al and Liu, is somewhat difficult and expensive to manufacture, and otherwise could be improved upon.

Accordingly, there is still a need in the art for a simpler means for dispensing medicine and liquid simultaneously to an infant which effectively masks the taste of the medicine while providing an accurate dosage of medicine.

SUMMARY OF THE INVENTION

The present invention meets that need by providing an improved nipple for use with a liquid and medicine dispensing bottle which includes a medicine tube disposed therein which allows medication and other liquids such as formula, juice, or water to be dispensed separately or simultaneously with the medicine. By "separately or simultaneously", it is meant that the medication can be dispensed from the bottle without other liquids, that other liquids such as formula, juice or water can be dispensed from the bottle without the medicine, and that medicine and other liquids can be dispensed simultaneous from the bottle. By medicine dispensing bottle, it is meant any bottle or device designed for the delivery of fluids.

According to one aspect of the present invention, a nipple is provided which is adapted for use with a medicine dispensing bottle and which permits liquid and medicine to be dispensed into an infant's mouth separately or simultaneously. The nipple includes a body portion, an open end having an annular flange for attachment to a bottle, and a discharge end for dispensing fluid. The discharge end includes at least one opening, and preferably, two openings for the medicine and liquid to flow through. The nipple is preferably comprised of a material selected from the group consisting of silicone resin, thermoplastics, rubber, latex, or elastomers.

The nipple further includes a medicine tube disposed in the body portion which is in communication with one of the discharge openings. In a preferred embodiment, the medicine tube is attached to the body portion by one or more webbed membranes which support the tube within the nipple and prevents it from becoming dislodged or torn from the nipple during repeated attachment to and removal from a bottle. The one or more webbed membranes may be attached to the medicine tube at various points along the length of the tube and, in one embodiment, a webbed membrane is tapered inward toward the open end of the nipple.

The medicine tube is disposed within the nipple such that when the nipple is attached to a dispensing bottle, the liquid and medicine are completely isolated from each other and are not mixed together or diluted prior to dispensing, eliminating the problem of dilution and contamination.

In one embodiment of the invention, the medicine tube is disposed within the center of the body portion of the nipple. In an alternative embodiment, the medicine tube is disposed on one side of the body portion of the nipple. The medicine tube may vary in length, diameter, thickness and shape. For example, in one embodiment, the medicine tube extends from the open end of the nipple to the discharge end. In another embodiment, the medicine tube is disposed within the discharge end of the nipple. In yet another embodiment, the medicine tube extends beyond the open portion of the nipple.

The nipple may be essentially hollow, or alternatively, the discharge end of the nipple may be totally or partially filled in with silicone or other suitable materials. In this embodiment, the filled portion includes one or more openings therein which allow fluids to flow through.

The design of the nipple may vary depending on the desired end use. For example, where the nipple is used for nutritional purposes, it is preferred that the nipple include two discharge openings for dispensing medicine and/or liquid nutrition. In most other embodiments, the nipple preferably has two or more discharge openings, one opening which allows medicine to flow through and one or more openings which allow other fluids from the bottle to flow through.

In another embodiment of the invention, the discharge end of the nipple is angled or may have any exterior shape or size. In yet another alternative embodiment of the invention, the nipple may include an integral collar extending from the annular flange such that the nipple may be easily attached to a dispensing bottle.

The nipple of the present invention is easy to manufacture as a one-piece unit including the body portion, medicine tube and webbed membrane. The nipple allows medicine and other liquids to be easily dispensed from a medicine dispensing bottle without any mixing or dilution of the medication prior to dispensing.

Accordingly, it is a feature of the invention to provide a nipple for use with a medicine dispensing bottle which allows medicine and other liquids to be dispensed separately or simultaneously. This, and other features and advantages of the present invention will become apparent from the following detailed description, the accompanying drawings, and the appended claims.

DETAILED DESCRIPTION OF THE PREFERRED EMBODIMENT

The nipple of the present invention provides several advantages over previous nipples used with bottles for dispensing medicines and other liquids simultaneously. The nipple and medicine tube are molded as an integral, one-piece unit, which ensures a leakproof seal when the nipple is secured to the bottle. Further, because the medicine tube is formed integrally with the nipple, the nipple can be washed as a single unit without the tube being separated or lost from the nipple. The nipple of the present invention can be used to dispense any liquid medications or other fluids regardless of the solution viscosity or granulation size in the solution.

Because the medicine tube comprises a separate channel within the nipple, there is no dilution or mixing of the medicine with the liquid contents of the bottle, ensuring accurate dosing. The nipple of the present invention also allows medicine to be administered at a controlled rate.

The use of a thin webbed membrane to attach the medicine tube to the nipple makes the nipple more stable to repetitive use. Without the use of the webbing, the unsupported medicine tube would not be able to withstand the twisting and/or pushing required when attaching and detaching the nipple from the bottle, possibly cutting off the flow of liquids to the tube, and eventually breaking after repetitive use. The webbing is preferably formed integrally with the nipple to provide greater stability.

The nipple (including the medicine tube and webbed membrane) is preferably formed from silicone, although other suitable materials may also be used, such as thermoplastic materials, rubber, latex, elastomers, etc.

Figure 1:
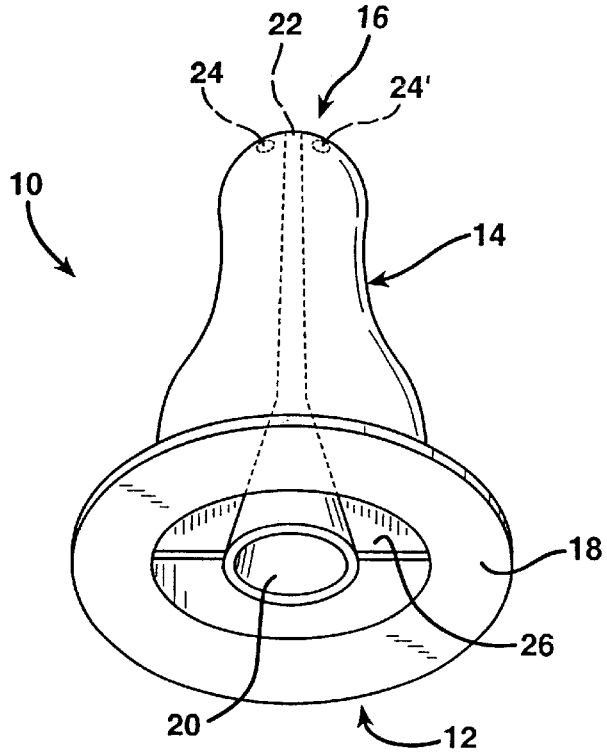
FIG. 1 is a rear elevational view of a nipple according to the present invention.

Referring now to FIG. 1, the nipple of the present invention is shown. The nipple 10 comprises an open end 12 which includes an annular flange 18 for attachment to a bottle, a body portion 14, and a discharge end 16 which, in the embodiment shown, includes three discharge openings 22, 24 and 24'. The openings may be provided in any shape or form such as holes, slits, etc. and may have varying positions on the discharge end. A medicine tube 20 is disposed within the nipple body portion 14 and preferably extends from the open end of the nipple, tapering inward toward the discharge end 16.

One end of the medicine tube 20 is in communication with opening 22 in the discharge end 16 of the nipple 10. As shown, the medicine tube 20 is connected to the inner body portion of the nipple by a webbed membrane 26. The webbing may be included on one side of the medicine tube 20 or both sides.

Figure 1A:
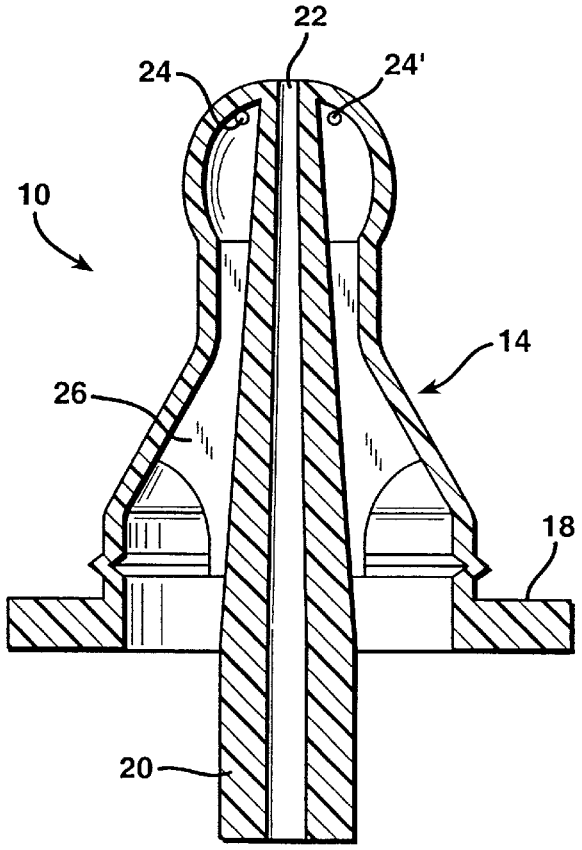
FIG. 1A is a side view of a nipple illustrating one embodiment of the invention.

In an alternative embodiment shown in FIG. 1A, the medicine tube 20 may extend beyond the open end of the nipple. It should be appreciated that the length and diameter of the medicine tube may vary, depending on the desired use for the nipple. Also as shown in FIG. 1A, the webbed membrane may be tapered inward toward the open end of the nipple.

Figure 2:
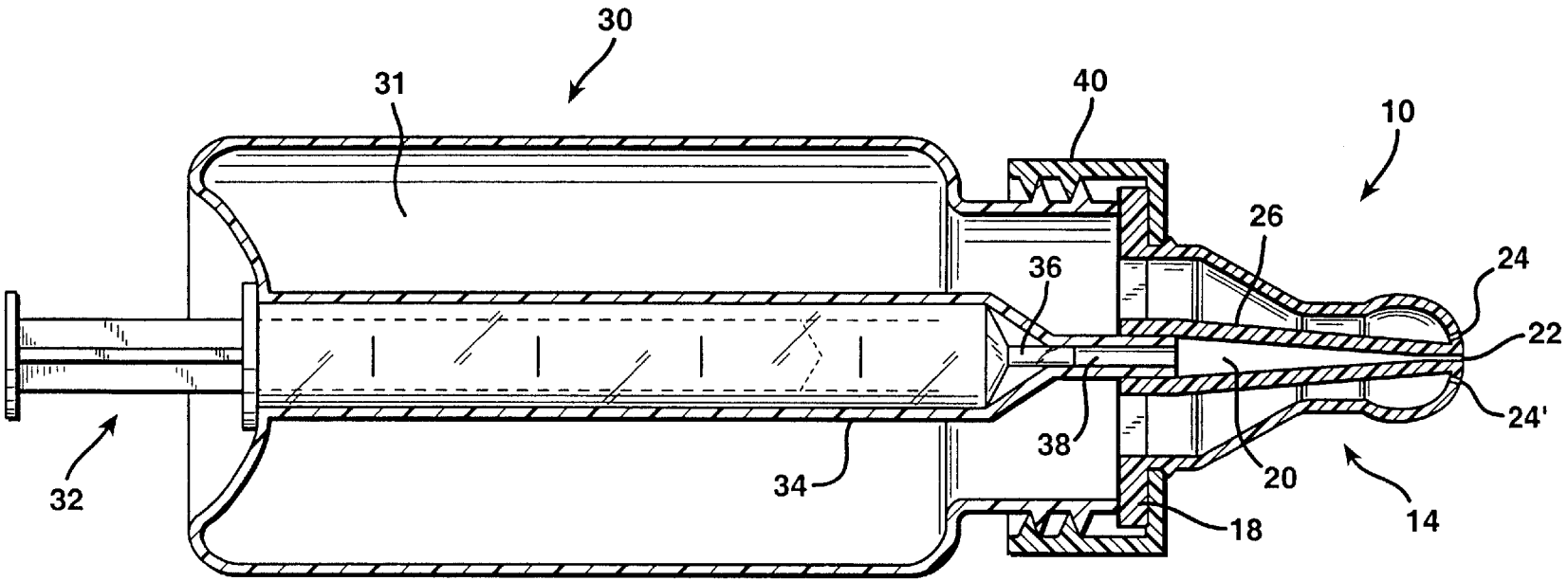
FIG. 2 is a perspective view showing the nipple installed on a medicine dispensing bottle.

FIG. 2 illustrates the nipple of the present invention attached to a bottle of the type for dispensing medicine and other fluids. The bottle 30 includes an inner reservoir 31 for holding liquids such as juice or formula and a receptacle 34 which houses a syringe assembly 32 which is used to dispense medicine into the nipple, all as disclosed in my earlier U.S. Pat. No. 5,244,122, which is hereby incorporated by reference.

As shown, the annular flange 18 of the nipple aids in sealing the bottle when the nipple is secured to the bottle via a conventional collar 40 which screws onto the threaded mouth of the bottle. When the nipple 10 is secured to the bottle, medicine can pass from the receptacle 34 to the medicine tube 20 without escaping into the liquid contents of reservoir 31 because the receptacle end 38 forms a snug fit within the tube. If desired, the end of the medicine tube 20 which contacts the receptacle end 38 may include an annular flange, or an O-ring or notch (not shown) which is designed to slip over the medicine receptable and aid in forming a fluid tight seal.

In use, liquid such as juice or formula may be contained in the reservoir 31. When an infant engages in sucking the liquid from reservoir 31 of the bottle, the liquid exits the nipple through openings 24 and 24'. As the infant is sucking the liquid, the syringe 32 is used to slowly inject medicine into receptacle end 38 and medicine tube 20 into the infant's mouth via opening 22. Thus, the medicine becomes mixed in the infant's mouth with the juice or formula, effectively masking the taste of the medicine. It should be appreciated that while the nipple allows simultaneous dispensing of liquid and medicine, it is also possible to dispense the liquid and medicine separately, i.e., the liquid in the bottle may be dispensed without the medicine, and the medicine may be administered without any other liquid in the bottle.

It should also be appreciated that while it is preferred that the medicine and liquid exit the discharge end through separate openings, it is possible that the medicine and liquid may be provided from separate sources (not shown) into medicine tube 20 such that the medicine and liquid are provided simultaneously through a single opening 22.

While the nipple is described herein as being used for dispensing medicine, it should be appreciated that the nipple may also be used to dispense other fluids such as vitamins, formula, or concentrates, as well as encapsulated drugs dispersed in a liquid. The nipple may also be used to dispense solid drug forms such as pills, which can be crushed and added to a fluid for dispensing.

Figure 3:
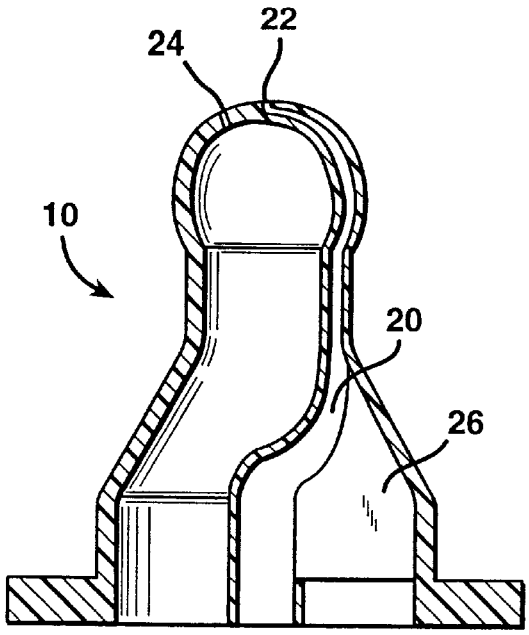
FIG. 3 is a side view of a nipple illustrating another embodiment of the invention.

An alternative embodiment of the invention is illustrated in FIG. 3 in which the medicine tube 20 is formed on one side of the body portion of the nipple. In the embodiment shown, the webbing is included only one side of the nipple body portion. Also as shown, the discharge end includes only two openings 22 and 24. The nipple preferably includes only two openings where the nipple is used for nutritional purposes, i.e., administering small amounts of nutrition to sick and/or premature infants.

Figure 4:
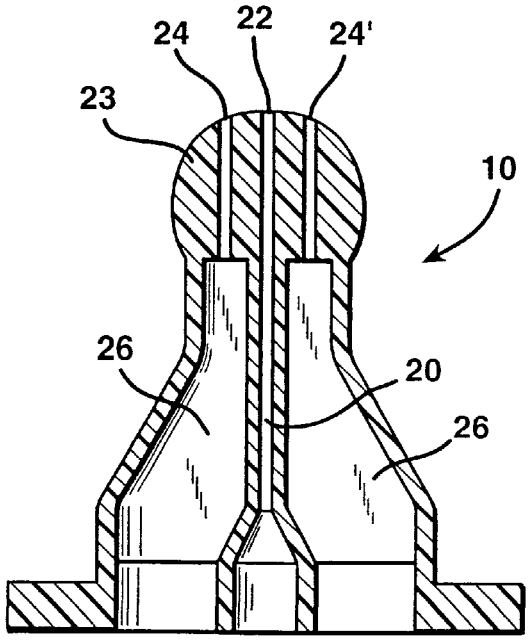
FIG. 4 is a side view of a nipple illustrating another embodiment of the invention.

FIG. 4 illustrates yet another embodiment of the invention in which the upper end of nipple is partially filled with silicone 23 or other suitable material. As shown in this embodiment, the discharge openings 24 and 24' extend through the silicone-filled portion.

Figure 5:
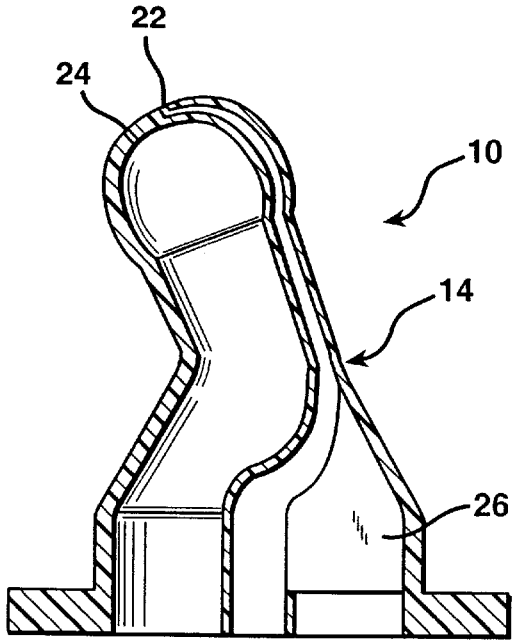
FIG. 5 is a side view of a nipple illustrating another embodiment of the invention.

FIG. 5 illustrates another embodiment of the invention in which the medicine tube 20 is disposed on one side of the nipple body portion 14. As shown, the nipple is angled. It should be appreciated that the nipple of the present invention may also be configured to fit a nursing bottle which is angled.

Figure 6:
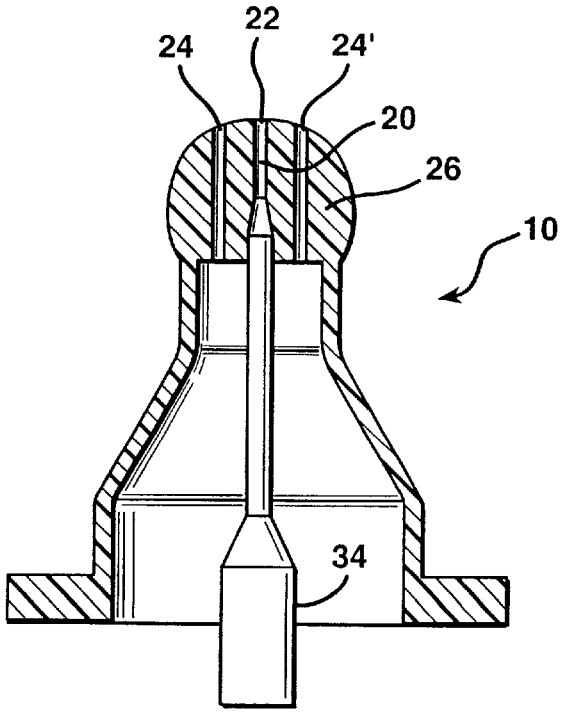
FIG. 6 is a side view of a nipple illustrating another embodiment of the invention.

FIG. 6 illustrates another embodiment of the invention in which the medicine dispensing tube 20 is shorter in length and is contained in an upper portion of the nipple body. As shown in this embodiment, the receptacle 34 of the bottle extends upward into nipple body portion so that it fits snugly within the medicine tube. The nipple includes webbing 26 in the upper portion of the nipple body to support the medicine tube. It should be appreciated that the length or slope of the medicine tube may vary as long as it functions adequately to dispense the medicine into the appropriate discharge opening.

Figure 7:
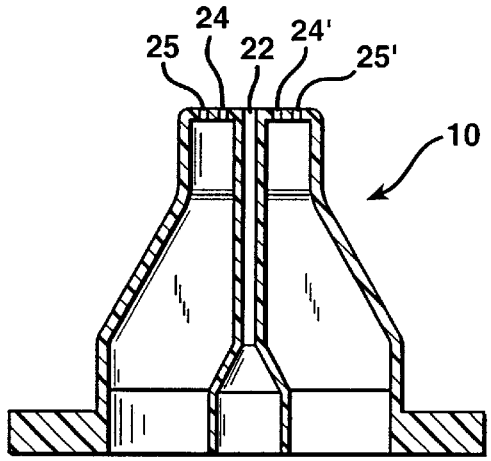
FIG. 7 is a side view of a nipple illustrating another embodiment of the invention.

FIG. 7 illustrates yet another embodiment of the invention in which the nipple is shortened in length and contains five discharge openings 22, 24, 24', 25, and 25' such that the nipple may be used for transitional purposes.

It should be appreciated that the nipple may be produced in a variety of shapes depending on the desired use. For example, the shape of the nipple may be configured so as to conform with disposable bottles which use a liner. The nipple may be also shaped to accommodate infants having special needs, such as premature infants, or infants having a cleft palate or other orthodontic needs.

Figure 8:
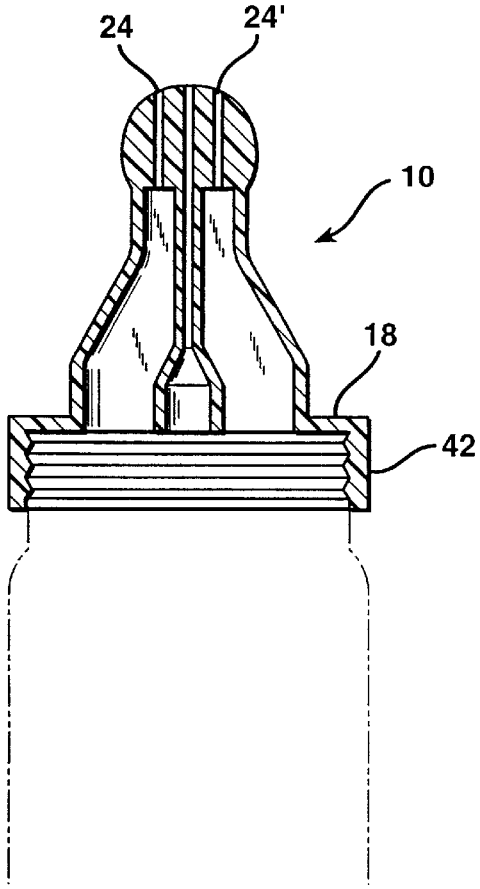
FIG. 8 is a side view of a nipple illustrating another embodiment of the invention.

FIG. 8 illustrates another embodiment of the invention in which the nipple includes a collar 42 extending from flange 18. The collar is preferably formed integrally with the nipple. The nipple of this embodiment may be used in conjunction with pre-filled disposable bottles or with other bottles where attachment with a collar is desired.

It should be appreciated that while the nipple of the present invention has been described primarily for use with infants, the nipple may also be used for adult geriatric and veterinary applications.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A nipple adapted for use with a medicine dispensing bottle, said nipple comprising a body portion, an open end having an annular flange for attachment to said bottle, and a discharge end for dispensing fluid, said discharge end including at least one opening, said nipple further including a medicine tube disposed on one side of said body portion which is in communication with said opening, said medicine tube being attached to said body portion by a webbed membrane extending from said open end of said nipple to the midpoint of said nipple, said nipple permitting medicine and other liquids to be dispensed into an infant's mouth separately or simultaneously.

2. A nipple as claimed in claim 1 in which said discharge end is angled.

* * * * *